US005617917A

United States Patent [19]

Squires

[11] Patent Number: 5,617,917

[45] Date of Patent: Apr. 8, 1997

[54] INTEGRAL BLOWOUT PREVENTER AND FLOW TEE

[75] Inventor: Andrew Squires, Calgary, Canada

[73] Assignee: FCE Flow Control Equipment Ltd., Edmonton, Canada

[21] Appl. No.: 511,432

[22] Filed: Aug. 4, 1995

[30] Foreign Application Priority Data

Jul. 11, 1995 [CA] Canada ..... 2153612

[51] Int. Cl.[6] ..... E21B 33/06

[52] U.S. Cl. ..... 166/85.4; 166/95.1

[58] Field of Search ..... 166/85.4, 95.1, 166/97.1, 85.1, 75.11, 379; 251/1.1–1.3

[56] References Cited

U.S. PATENT DOCUMENTS

| | | | |
|---|---|---|---|
| 1,517,504 | 12/1924 | Hansen | 251/1.3 X |
| 2,002,062 | 5/1935 | Howard | 251/1.3 X |
| 2,336,977 | 12/1943 | Bean et al. | 166/97.1 |
| 3,227,229 | 1/1966 | Wakefield, Jr. | 166/75.11 X |
| 4,860,826 | 8/1989 | Land | 166/85.4 X |

*Primary Examiner*—Hoang C. Dang
*Attorney, Agent, or Firm*—Browning Bushman

[57] ABSTRACT

A wellhead flow tee and blow out preventing device having housings joined providing an integral unit. The housing includes a first upper portion with an upper mounting flange on an upper end thereof and a second lower portion with a lower mounting flange on a lower end thereof and a primary central fluid flow passage extending therethrough from one of said flanges to the other. The upper portion has at least one secondary fluid flow passage extending through a sidewall of said housing from said primary passage to an outer surface of said housing and to which external piping is connected. This part of the housing is the flow tee. The second lower housing portion has a pair of oppositely directed passages extending radially outwardly from the central passage to an outer surface of a sidewall of such housing portion. The oppositely directed passages are provided with selectively movable gating members for use in selectively preventing fluid flow through the primary passage. Each of the first and second housing portions having a neck portion surrounding the primary passage with one projecting toward the other and disposed in abutting relation and these neck portions are connected one to the other with a continuous continuity circumferentially around the primary passage.

16 Claims, 3 Drawing Sheets

INTEGRAL BLOWOUT PREVENTER AND FLOW TEE

FIELD OF INVENTION

This invention relates to wellhead surface equipment, more specifically to the wellhead equipment typically referred to as a blow out preventer and a pumping tee connection.

BACKGROUND OF THE INVENTION

A blow out preventer (BOP) and pumping tee connection (flow tee) are common wellhead components that are used on most sucker rod pumped wells in the oil industry. These are two separate components that may be mounted one on top of the other. They are connected by bolts passing through holes in abutting flanges. The purpose of the flow tee is to connect the production flowline(s) to the wellhead production tubing. The production flowline(s) are connected to the flow tee by either a threaded connection or flanged connection.

The purpose of the BOP is to provide a means of shutting in a well (sealing off the production tubing) in which a sucker rod is present in the wellbore. The BOP consists of a housing with two ram blocks therein made of pliable elastomers which are squeezed together by advancing toward one another ram screws that are located on opposite sides of the device. The ram blocks seal off the annular area between the rod and the production tubing providing an effective pressure/fluid seal around the polished rod. This finely finished (polished) rod connects the sucker rod string to a driver on the surface. The fine finish on the rod is required as the rod must pass through a packing gland (stuffing box) which seals the exit point of the rod from the wellhead assembly.

In progressive cavity pumped wells a driver above ground spins the sucker rod string to drive a downhole rotational pump. The drive units are typically mounted on, or slung, or hung from the wellhead assembly. Wellhead height is a major concern as excessive height can lead to wellhead instability problems. Also there are serviceability problems due to the height at which the typically heavy and bulky drivehead components are mounted.

SUMMARY OF INVENTION

An object of the present invention is to combine the functionality of these two separate wellhead components (BOP and Flow Tee) into an integral unit.

A further principle object is to reduce the overall height of the pumping wellhead assembly in comparison to the collective height of an individual BOP and a flow tee component mounted one on top of the other.

In accordance with the present invention there is provided a flow tee and blow out preventer having a unitary housing providing a compact profile and thereby a more torsionally stable platform for the drivehead assembly. The unitary housing lessens the number of connections and by this the overall torsional rigidity of the wellhead assembly is also enhanced.

There is particularly provided in accordance with the present invention a housing for use in providing a wellhead flow tee and blow out preventing device, said housing comprising a first upper portion with an upper mounting flange on an upper end thereof and a second lower portion with a lower mounting flange on a lower end thereof and a primary central fluid flow passage extending therethrough from one of said flanges to the other, said first upper portion having at least one secondary fluid flow passage extending through a sidewall of said housing from said primary passage to an outer surface of said housing and including means for connecting external piping to said secondary passage, said second lower portion having a pair of oppositely directed passages extending radially outwardly from said central passage to an outer surface of a sidewall of such housing portion, said oppositely directed passages providing means for mounting therein selectively movable gating members for use in preventing fluid flow through said primary passage, each of said first and second housing portions having a neck portion surrounding said primary passage with one projecting toward the other and disposed in abutting relation and means connecting one such neck to the other with continuous continuity circumferentially around said primary passage.

LIST OF DRAWINGS

The invention is illustrated by way of example in the accompanying drawings wherein.

DESCRIPTION OF PREFERRED EMBODIMENT

Figure 1:
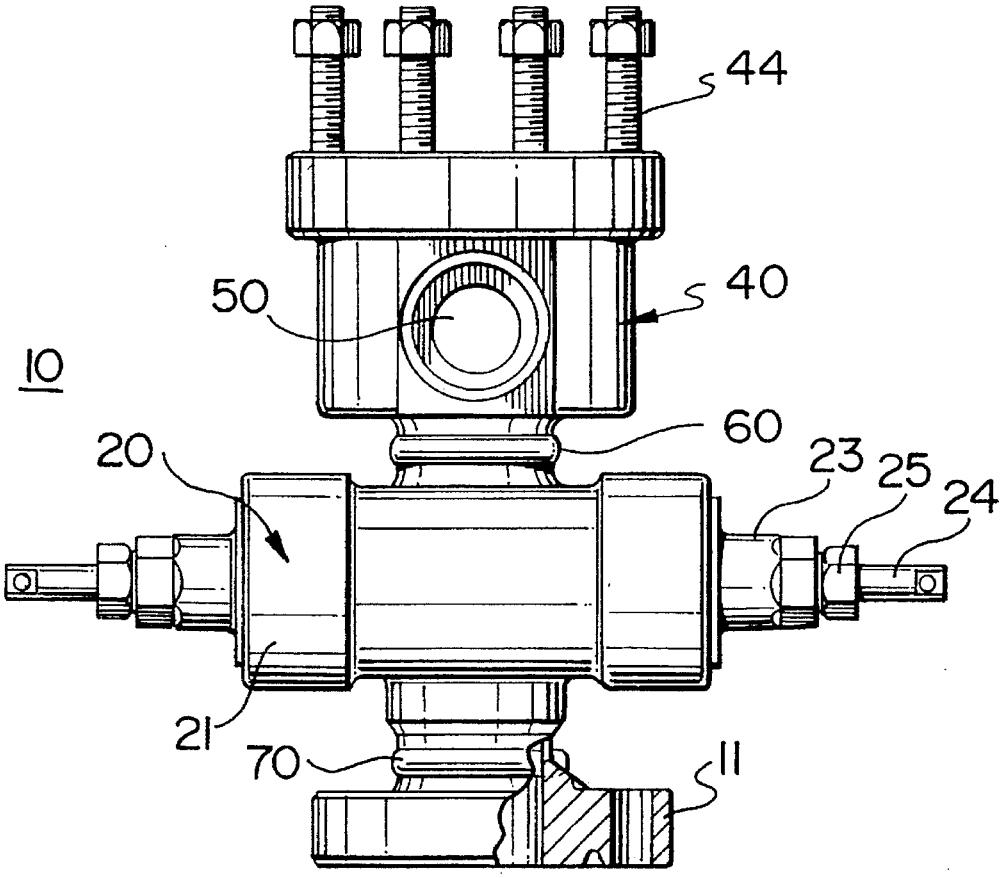
FIG. 1 is a front elevational view of a flow tee and blowout preventing device provided in accordance with the present invention for a wellhead.
Figure 2:
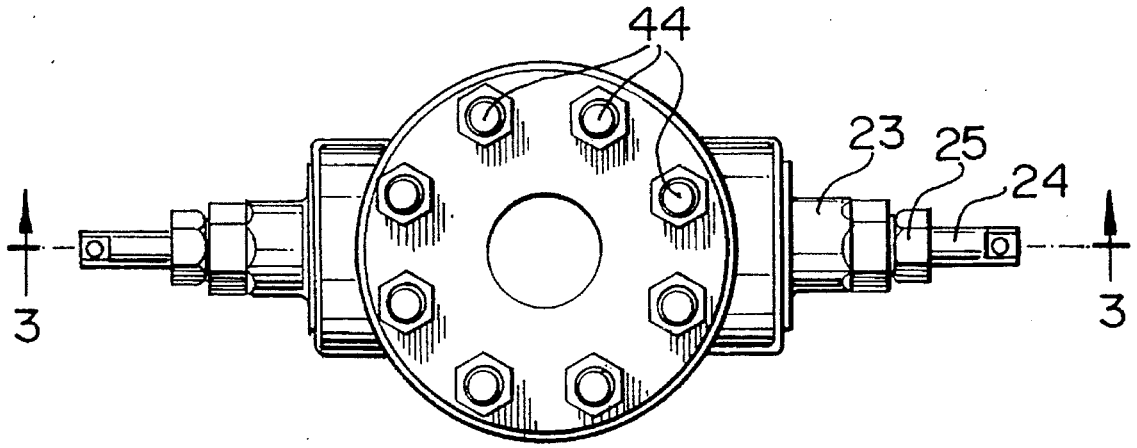
FIG. 2 is a top plan view of FIG. 1.

Referring to the drawings there is illustrated in FIG. 1 a wellhead device 10 comprising a blowout preventing device (BOP) 20 and a flow tee 40 rigidly and permanently joined together as designated at 60.

Figure 3:
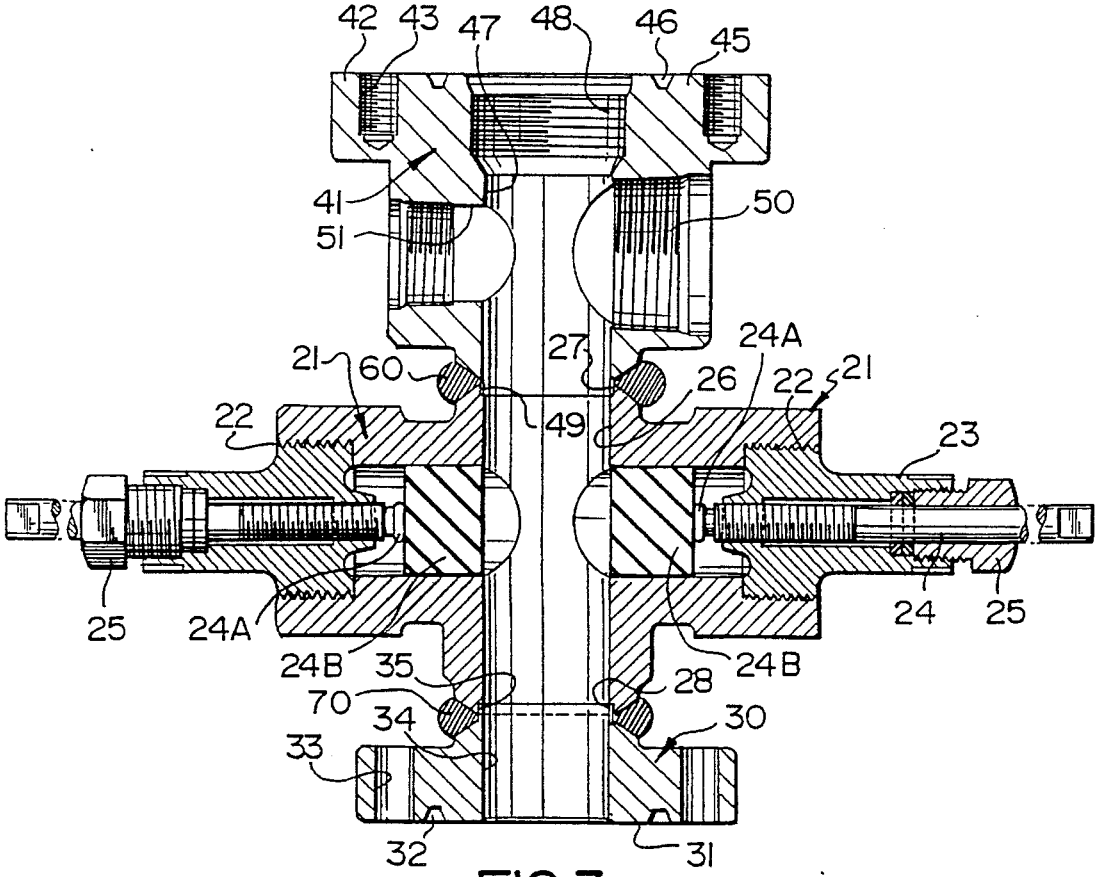
FIG. 3 is a vertical sectional view of the housing taken essentially along line 3—3 of FIG. 2 with the flow shut off diagrammatically illustrated and with the flow tee rotated 90° about a vertical axis relative to the blowout preventing device in comparison with FIG. 1.

The BOP 20 has a housing 21 with a pair of aligned threaded apertures 22 (see FIG. 3) for receiving respective ones of a pair of internally and externally threaded sleeves 23. These sleeves being internally threaded receive respective ones of a pair of threaded ram screws that can be rotated by way of an outwardly extending shaft 24. A gland nut 25 retains a sealing material preventing fluid leakage. The ram screws each have a plunger portion 24A and by rotating shaft 24 respective ones of a pair of ram blocks 24B, made of pliable elastomers, are squeezed together by the advancing ram screws. This provides a gate means to seal off the production tubing should that be desired or required. The ram screws and ram blocks, i.e. flow preventer components are of conventional construction well known in the art.

The flow tee 40 has a housing 41 with an annular mounting flange 42 and in this flange there are a plurality of circumferentially spaced apart threaded passages 43 for receiving respective ones of a plurality of mounting studs 44. The flange 42 has an upper flat surface 45 in which there is an annular groove 46 for receiving an O-sealing ring. The housing 41 has a through fluid flow passage 47 with a threaded end 48 larger in diameter than the through passage and at the opposite end there is an annular projection or spigot 49. Transverse to passage 47 are respective first and second spaced apart passages 50 and 51, each of which is threaded for connecting external piping thereto. In the illustrated embodiment the passage 50, for example, may be three inches in diameter while passage 51 may be two inches in diameter and as illustrated these passages are axially aligned but this need not be so.

The housing 21 has a through passage 26 axially aligned with and of the same diameter as through passage 47 in the flow tee 40. At the opposite ends of this through passage 26 there are respective annular recesses or enlargements 27 and 28. Enlargement 27 is dimensioned for a tight fit relation with the spigot (or projection) 49 on the flow tee 40.

The BOP has a mounting flange 30 with an outer flat face 31 in a plane parallel to the plane of the flat face 45 of the flow tee. In the flat face 31 there is an annular groove 32 for receiving an O-ring seal. The flange has a plurality of circumferentially spaced through holes 33 for use in bolting the device 10 to the wellhead casing.

The mounting flange has a through passage 34 axially aligned with and being of the same diameter as through passage 26 of the BOP. An annular flange or spigot 35 projects upwardly in snug fitting relation into a recess or enlargement 28 in the passage 26 of housing 21.

The housing 21, the housing 41 and the mounting flange 30 are separately cast elements joined initially together by the spigots 35 and 49 projecting into the respective recesses as described above. At this point one part can be rotated relative to the other about the longitudinal axes of through passages 47, 26, 34 for any desired relative orientation about such axis of the housing portions relative to one another. When the faces 31 and 45 have been checked for being in planes that are parallel to one another and with the relative orientation of passages 50 and 51 with respect to the axis of passages 22 being as desired, the housing 41 is permanently attached to housing 21 by a bead weld 60 and the flange mounting 30 is permanently attached to housing 21 by a bead weld 70. This can be done at the place of manufacture, or if desired, at the installation site. The interfitting spigots and sockets or recesses facilitate initial alignment of the parts and rotation of one part relative the other about the axis of aligned end-to-end passages 47, 26 and 34. This permitted rotation permits any relative positioning of the parts as may be desired prior to welding to permanently join together the housings. The welds provide a continuous interconnection of the housings circumferentially around the primary central flow through passage that consists of the end-to-end passages 47, 26 and 34.

In an actual apparatus constructed as illustrated in FIG. 1 the distance between flat faces 31 and 45 is approximately 16.56 inches and this is approximately 10 inches less than would be the case with separate mounting flanges on housing 21 and housing 41 for joining the two together. This reduced height is very substantial providing substantially more dimensional stability than accomplished with the prior art devices and the reduced height also facilitates servicing at the wellhead. In the actual housing referred to the further dimensions are as follows: central through passage (47, 26, 34) each have a diameter of approximately 2¾", flange 42 a diameter of approximately 9.5", flange 30 a diameter of approximately 8.3", housing 41 a height of approximately 6.8" and the lower flange a height of approximately 2.5".

Figure 4:
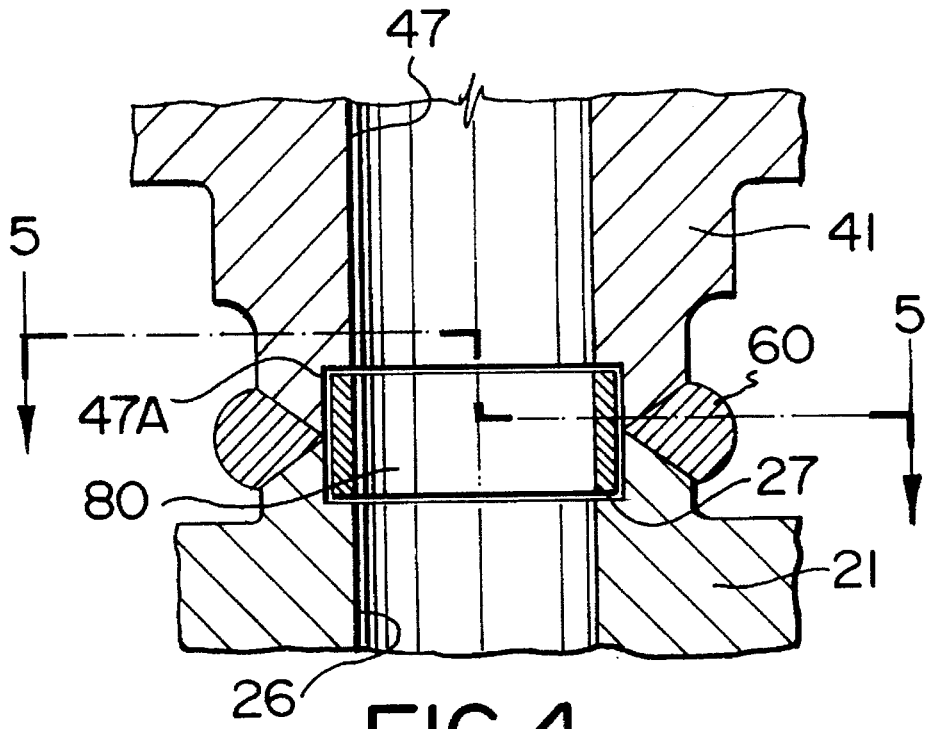
FIG. 4 is an elevational partial sectional view of a portion of the flow tee and BOP housings illustrating a sleeve joining the two.
Figure 5:
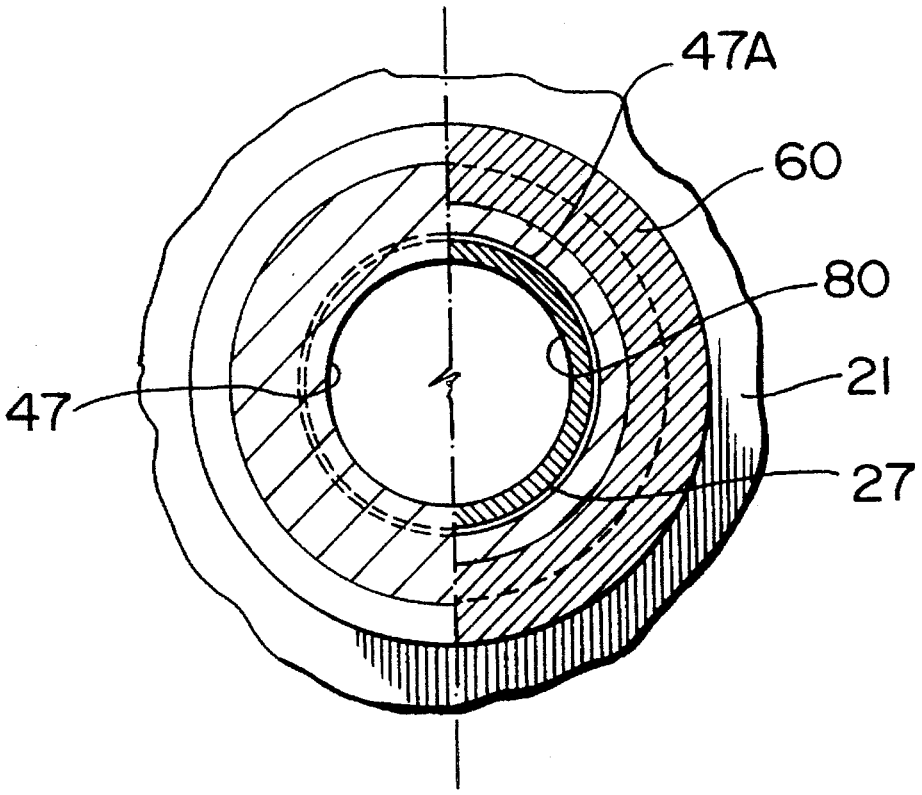
FIG. 5 is a view along the stepped section 5—5 of FIG. 4.

The housings preferably are cast individually and joined as hereinbefore described. They could however, with perhaps great difficulty be cast as an integral unit. The through passages may be provided during casting or machined later or both depending upon one's desires. The spigots 35 and 49 if desired may be replaced by an annular sleeve that projects into an annular enlargement of the central passage in each of the two housing portions being interconnected by such sleeve. For example spigot 49 shown in FIG. 3 may be an annular sleeve 80 as is illustrated in FIGS. 4 and 5. Referring to FIGS. 4 and 5, sleeve 80 has one end thereof projecting into the enlargement 27 in passage 26 of housing 21 and the other end thereof projecting into a similar enlargement designated 47A in the adjacent end of passage 47.

The housing is normally cast from high tensile low hardness steel. A suitable material may for example be ASTM A395. In low to medium pressure pumping operations the working pressure might be 1500 psi and the castings in such case are tested and pressure rated for 2000 psi. Suitable materials can be selected and the housing designed for much higher operating pressures if desired. The housing can be cast from materials conforming to NACE MR0175 specifications for sour service operations.

While steel is the normal material some installations may permit use of plastics materials.

I claim:

1. A housing for use in providing a wellhead flow tee and blow out preventing device, said housing comprising a first upper portion with an upper mounting flange on an upper end thereof and a second lower portion with a lower mounting flange on a lower end thereof and a primary central fluid flow passage extending therethrough from one of said flanges to the other, said first upper portion having at least one secondary fluid flow passage extending through a sidewall of said housing from said primary passage to an outer surface of said housing and including means for connecting external piping to said secondary passage, said second lower portion having a pair of oppositely directed passages extending radially outwardly from said central passage to an outer surface of a sidewall of such housing portion, said oppositely directed passages providing means for mounting therein selectively movable gating members for use in preventing fluid flow through said primary passage, each of said first and second housing portions having a neck portion surrounding said primary passage with one projecting toward the other and disposed in abutting relation and means integrally connecting one such neck to the other providing a permanent connection that has continuous continuity circumferentially around said primary passage.

2. A housing as defined in claim 1 wherein said neck portions have, in interfitting internested relation, a spigot and a recess, said spigot projecting from one of said neck portions into a recess in the other of said neck portions.

3. A housing for use in providing a wellhead flow tee and blow out preventing device, said housing comprising a first upper portion with an upper mounting flange on an upper end thereof and a second lower portion with a lower mounting flange on a lower end thereof and a primary central fluid flow passage extending therethrough from one of said flanges to the other, said first upper portion having at least one secondary fluid flow passage extending through a sidewall of said housing from said primary passage to an outer surface of said housing and including means for connecting external piping to said secondary passage, said second lower portion having a pair of oppositely directed passages extending radially outwardly from said central passage to an outer surface of a sidewall of such housing portion, said oppositely directed passages providing means for mounting therein selectively movable gating members for use in preventing fluid flow through said primary passage, each of said first and second housing portions having a neck portion surrounding said primary passage with one projecting toward the other and disposed in abutting relation and means connecting one such neck to the other with continuous continuity circumferentially around said primary passage, wherein said neck portions have, in interfitting internested relation, a spigot and a recess, said spigot projecting from one of said neck portions into a recess in the other of said neck portions and wherein said continuous circumferential connection comprises a continuous bead weld.

4. A housing as defined in claim 1 wherein said neck portions are integrally moulded during manufacture.

5. A housing as defined in claim 1 wherein said upper and lower flanges each have a flat face in a plane transverse to said primary flow through passage and wherein said planes are parallel to one another.

6. A housing as defined in claim 5 wherein each of said flanges have a plurality of circumferentially spaced apertures.

7. A housing as defined in claim 6 wherein said apertures in said upper mounting flange are threaded recesses for receiving therein threaded mounting studs and wherein said apertures in said lower mounting flange are holes extending through such flange.

8. A housing as defined in claim 1 wherein said secondary fluid flow passage has a threaded entry portion extending inwardly from said housing outer surface providing said means for connecting external piping thereto.

9. A housing as defined in claim 1 including gating members selectively adjustably mounted in each of said oppositely directed passages.

10. A housing as defined in claim 5 wherein the distance between said planes is less than twenty inches.

11. A housing as defined in claim 5 wherein the distance between said planes is less than seventeen inches.

12. A housing as defined in claim 5 wherein said primary flow through passage has a diameter of approximately 3 inches, wherein there are two secondary passages in said flow tee one being approximately 3 inches in diameter and the other 2 inches in diameter, wherein said lower mounting flange has a diameter in the range of 8.19" to 8.31", wherein the overall height of said upper portion is approximately 7".

13. A housing as defined in claim 1 wherein said lower mounting flange comprises a separate housing with a neck projecting upwardly therefrom and means permanently connecting such neck to the BOP housing with continuous continuity circumferentially around said primary passage.

14. A housing for use in providing a wellhead flow tee and blow out preventing device, said housing comprising a first upper portion with an upper mounting flange on an upper end thereof and a second lower portion with a lower mounting flange on a lower end thereof and a primary central fluid flow passage extending therethrough from one of said flanges to the other, said first upper portion having at least one secondary fluid flow passage extending through a sidewall of said housing from said primary passage to an outer surface of said housing and including means for connecting external piping to said secondary passage, said second lower portion having a pair of oppositely directed passages extending radially outwardly from said central passage to an outer surface of a sidewall of such housing portion, said oppositely directed passages providing means for mounting therein selectively movable gating members for use in preventing fluid flow through said primary passage, each of said first and second housing portions having a neck portion surrounding said primary passage with one projecting toward the other and disposed in abutting relation and means connecting one such neck to the other with continuous continuity circumferentially around said primary passage, wherein said lower mounting flange comprises a separate housing with a neck projecting upwardly therefrom and means permanently connecting such neck to the second lower portion of the housing with continuous continuity circumferentially around said primary passage and including a spigot and recess inter-fitting in internested relation interconnecting said lower flange and the remainder of said housing.

15. A housing for use in providing a wellhead flow tee and blow out preventing device, said housing comprising a first upper portion with an upper mounting flange on an upper end thereof and a second lower portion with a lower mounting flange on a lower end thereof and a primary central fluid flow passage extending therethrough from one of said flanges to the other, said first upper portion having at least one secondary fluid flow passage extending through a sidewall of said housing from said primary passage to an outer surface of said housing and including means for connecting external piping to said secondary passage, said second lower portion having a pair of oppositely directed passages extending radially outwardly from said central passage to an outer surface of a sidewall of such housing portion, said oppositely directed passages providing means for mounting therein selectively movable gating members for use in preventing fluid flow through said primary passage, each of said first and second housing portions having a neck portion surrounding said primary passage with one protecting toward the other and disposed in abutting relation and means connecting one such neck to the other with continuous continuity circumferentially around said primary passage and wherein said upper and lower housing portions and said lower mounting flange are three separate cast elements interconnected by respective upper and lower bead welds each extending continuously circumferentially around said central passage.

16. A housing as defined in claim 15 including a pair of sleeves located in said primary flow passage, a first one of said sleeves projecting into enlargements in such passage respectively in said upper and lower housings and the other one of such sleeves projecting into enlargements in such passage respectively in said lower housing portion and said lower mounting flange.

* * * * *

UNITED STATES PATENT AND TRADEMARK OFFICE

CERTIFICATE OF CORRECTION

PATENT NO. : 5,617,917

DATED : April 8, 1997

INVENTOR(S) : Andrew Squires

It is certified that error appears in the above-indentified patent and that said Letters Patent is hereby corrected as shown below:

In column 6, line 39, change "protecting" to --projecting--.

Signed and Sealed this

First Day of July, 1997

Bruce Lehman

*Attest:*

BRUCE LEHMAN

*Attesting Officer*

*Commissioner of Patents and Trademarks*